United States Patent [19]

Barnard et al.

[11] 4,087,143

[45] May 2, 1978

[54] ICE MAKER CABINET DOOR CONSTRUCTION

[75] Inventors: Walter C. Barnard, White Bear Lake, Minn.; Kenneth J. Dahlstrom, St. Croix Falls, Wis.

[73] Assignee: Whirlpool Corporation, Benton Harbor, Mich.

[21] Appl. No.: 655,704

[22] Filed: Feb. 6, 1976

[51] Int. Cl.[2] ..... E06B 3/00

[52] U.S. Cl. ..... 312/138 R; 312/214; 312/317 R; 126/190

[58] Field of Search ..... 312/138 R, 138 A, 214, 312/276, 326, 327, 320, 317 R, 317 A; 126/190

[56] References Cited

U.S. PATENT DOCUMENTS

| | | | |
|---|---|---|---|
| 1,404,503 | 1/1922 | Williams | 312/214 |
| 2,072,820 | 3/1937 | Kessler | 126/190 |
| 2,845,323 | 7/1958 | Seibert, Jr. | 312/317 R |
| 3,207,565 | 9/1965 | Scharge | 312/320 |
| 3,294,461 | 12/1966 | Barnard et al. | 312/214 |
| 3,352,614 | 11/1967 | Andersen | 312/327 |
| 3,393,950 | 7/1968 | Dutcher et al. | 312/317 R |
| 3,680,937 | 8/1972 | Steeley | 312/138 |
| 3,731,035 | 5/1973 | Jarvis et al. | 126/190 |
| 3,773,399 | 11/1973 | Sulcek | 312/214 |

FOREIGN PATENT DOCUMENTS

| | | | |
|---|---|---|---|
| 522,217 | 2/1956 | Canada | 312/214 |
| 541,758 | 6/1957 | Canada | 312/214 |
| 872,764 | 9/1961 | United Kingdom | 312/138 R |

*Primary Examiner*—Paul R. Gilliam
*Assistant Examiner*—Victor N. Sakran
*Attorney, Agent, or Firm*—Wegner, Stellman, McCord, Wiles & Wood

[57] ABSTRACT

A door construction for a cabinet such as an ice maker cabinet. The door includes a panel which is reinforced by a framework, with a portion of the door being clamped between a portion of the framework and a support rail. Hinge pins are provided on the cabinet and the door is supported on the pins solely by the rails at opposite sides of the door in the selective positioning of the door in both open and closed positions. The door is adapted for facilitated installation and removal for facilitated servicing of the ice maker. The door manipulating handle is effectively connected to the mounting rails through the clamped door portion. A front decorative panel is secured to the door by side trim elements sandwiched between the side rails and the inner door panel.

19 Claims, 18 Drawing Figures

10
11
12
13
15
16
17
18
19
20
21
22
23
24
25
27
28
29
30
31
32
33
34
35
36
37
38
39
40
41
42
43
44
45
46
47
48
49
50
54

ICE MAKER CABINET DOOR CONSTRUCTION

BACKGROUND OF THE INVENTION

1. Field of the Invention

This invention relates to cabinet construction and in particular to a door construction for use in a cabinet such as an ice maker cabinet.

2. Description of the Prior Art

In one conventional form of ice cube maker marketed by the assignee hereof, the apparatus is housed in a cabinet having a door having an exposed door frame forming the structural support of the door. The present invention comprehends an improved simplified door construction eliminating such decorative frame. Other forms of door constructions of the prior art include that shown in U.S. Pat. No. 2,072,820 of Charles J. Kessler. In the Kessler patent an oven door is provided with a corner reinforcing member.

Walter C. Barnard et al in U.S. Pat. No. 3,294,461 owned by the assignee hereof, show a door construction for use in kitchen appliances such as dishwashers and the like. The construction includes improved fastener means for holding the trim about the door with means for hiding the fastening means from view so as to not distract from the appearance of the door construction.

Ival G. Dutcher et al in U.S. Pat. No. 3,393,950 owned by the assignee hereof, show a cabinet structure having a stabilizer device which moves to a stabilizing position when a downwardly opening front door of the cabinet is opened thereby to stabilize the cabinet against forward tipping.

In U.S. Pat. No. 3,773,399 of Charles E. Sulcek, owned by the assignee hereof, a refuse compactor is shown having interchangeable front panels. The door includes a picture frame-type edging means and a front mounting panel with means for mounting the different decorative panel configurations selectively thereto.

SUMMARY OF THE INVENTION

The present invention comprehends an improved door construction which is extremely simple and economical of manufacture while yet providing high strength. The improved construction eliminates the need for extensive decorative frames and the like.

The door construction of the present invention is readily removably installed in the cabinet opening for facilitated servicing of apparatus and machinery within the cabinet when desired.

The cabinet construction eliminates the need for forming of the inner and outer door panels to retain fastening means. More specifically, the present door construction affects a retention of the trim strip and inner door structures between the mounting rails and the reinforcement means.

More specifically, the present invention comprehends the improved door construction utilizing a pair of reinforcing tapping strips within a relatively weak inner door panel. Side portions of the door panel are clamped between the tapping strips and outer rail members. The door handle, in turn, is connected to the tapping strips whereby the handle is effectively connected to the rails.

The rails in turn are pivotally mounted to pivot pins carried by the cabinet at opposite sides of the front opening which is to be selectively closed by the door.

A decorative front panel is provided which is held in place by a portion of the side trim sandwiched between the side rail and the inner door panel. Additionally, the front panel may be secured in the door construction by a portion received between the handle and the inner door panel.

The door mounting rails are arranged to support the door on the pivot pins and may include stop means engageable with stops on the cabinet for pivoting the downward swinging of the door on the pivot pins.

The door construction is arranged for facilitated installation and removal relative to the pivot pins. In the illustrative embodiment, the door is arranged to be removed by the removal of either of the opposite side rails to permit the side of the door from which the rails has been removed to be brought forwardly from the cabinet and subsequently permitting the withdrawal of the opposite portion of the door laterally but from mounting engagement with the other pivot pin.

The door may further be arranged to be installed on the mounting pins with both rails being subsequently installed on the opposite sides of the door to secure the door in mounted association with the cabinet.

Thus, the door construction of the present invention is extremely simple and economical of manufacture while yet providing the highly desirable features discussed above.

DESCRIPTION OF THE PREFERRED EMBODIMENT

Figures 1, 2, 3:
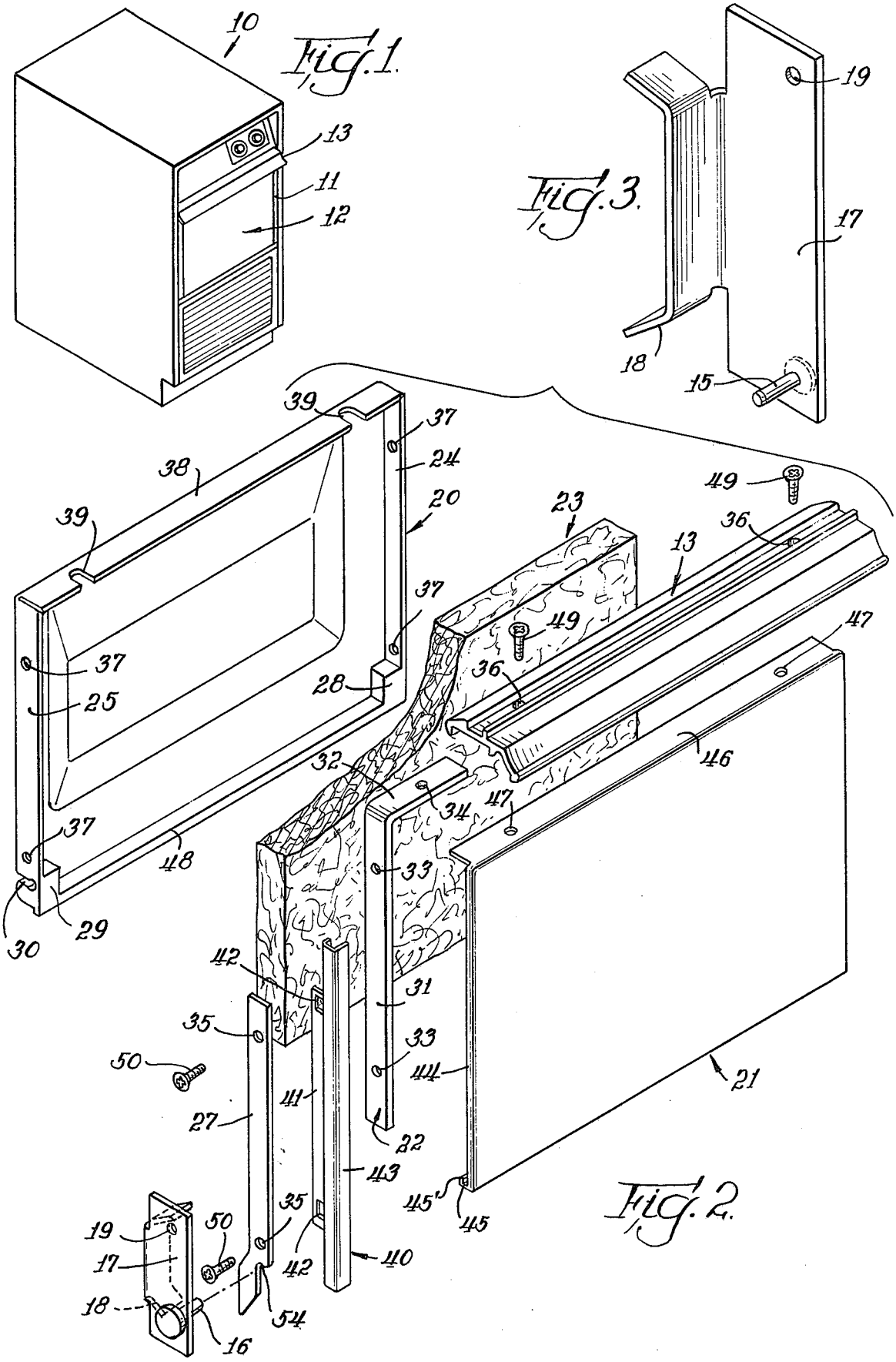
FIG. 1 is a perspective view of an ice maker having a door construction embodying the invention.
FIG. 2 is a fragmentary exploded view of the door construction thereof.
FIG. 3 is a perspective view of one of the pivot pin assemblies.

In the exemplary embodiment of the invention as disclosed in the drawing, a cabinet generally designated 10 is shown to define a front opening 11 selectively closed by a door generally designated 12. In the illustrated embodiment, the cabinet 10 comprises an ice cube maker cabinet wherein conventional ice cube making apparatus (not shown) is provided for making and storing quantities of ice cubes for selective removal through the front opening 11 by selective opening of door 12. It will be obvious to those skilled in the art that the door construction hereof is advantageously adaptable for use in other appliances requiring such selectively manipulatable doors.

Figure 4:
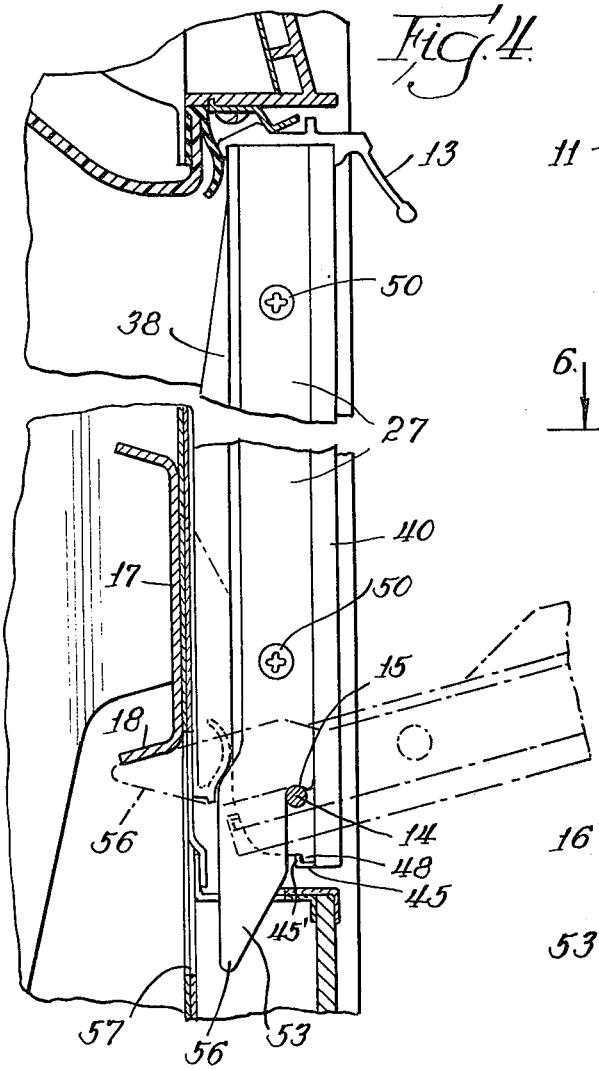
FIG. 4 is a fragmentary vertical section illustrating the disposition of the door in a closed position within the cabinet in full lines and a portion of the door in an open position in broken lines.
Figure 5:
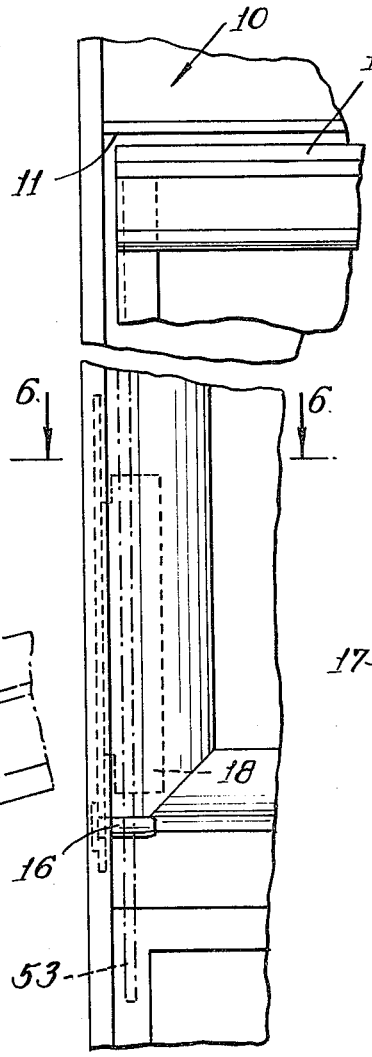
FIG. 5 is a fragmentary front elevation of the door construction.
Figure 6:
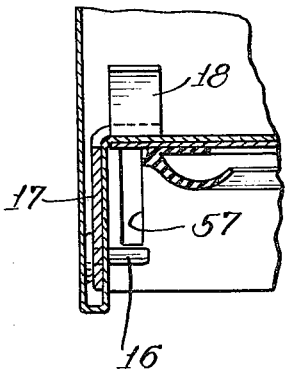
FIG. 6 is a fragmentary horizontal section taken substantially along the lines 6—6 of FIG. 5.

Door 12 is provided with a handle 13 for use in manually swinging the door about a lower pivot axis 14 between an upright closed position as shown in full lines in FIG. 4 and a forwardly extending open position as shown in broken lines therein. Pivot axis 14 is defined by a pair of pivot pins 15 and 16 at opposite sides of the door opening 11 as illustrated in FIGS. 2, 3, and 4. As shown in FIG. 3, the hinge pin may be mounted to a mounting plate 17 further provided with a rear stop portion 18. Plate 17 may be secured to the cabinet 10 at the side of opening 11 by suitable securing means extending through an opening 19 in an upper portion of the plate.

As seen in FIG. 2, the door construction includes an inner door panel generally designated 20, a decorative front panel generally designated 21, a pair of reinforcement members generally designated 22, and an insulating panel generally designated 23.

The inner door panel includes a pair of side flange portions 24 and 25 adapted to be clamped between the reinforcing members 22 and outer rails 26 and 27. The inner door includes a pair of mounting block portions 28 and 29, each provided with a rearwardly opening slot 30 for receiving the corresponding pivot pins 15 and 16.

The reinforcing members 22 define L-shaped members having a vertical portion 31 and a horizontal top portion 32. The vertical portion 31 of each reinforcing member is provided with a pair of openings 33 and the upper portion 32 thereof is provided with an opening 34. The mounting side rails 26 and 27 are provided with a pair of openings 35 alignable with openings 33 of the reinforcing members. Handle 13 is provided with a pair of openings 36 alignable with openings 34 of the reinforcing members.

Side flanges 24 and 25 of the inner door 20 are provided with a pair of openings 37 alignable with openings 33 of the reinforcing members and 35 of the mounting rails. A top flange 38 of the inner door is provided with a pair of rearwardly opening slots 39 alignable with the handle openings 36.

A pair of trim strips generally designated as 40 is provided, one each at opposite sides of the door, each of which trim strips includes a rear portion 41 having a pair of openings 42, and a forward portion 43.

The front decorative panel 21 includes side flanges 44, a bottom flange 45 with a turned edge portion 45' and a top flange 46 provided with a pair of openings 47.

The inner door panel 20 includes a bottom flange 48. Turned edge portion 45' of bottom flange 45 hooks over inner door flange 48.

A pair of screws 49 is provided for securing the handle 13 in the door construction and two pairs of screws 50 are provided for securing the rails to the opposite sides of the door construction.

Figures 9, 10, 11, 12, 13, 14, 15, 16, 17, 18:
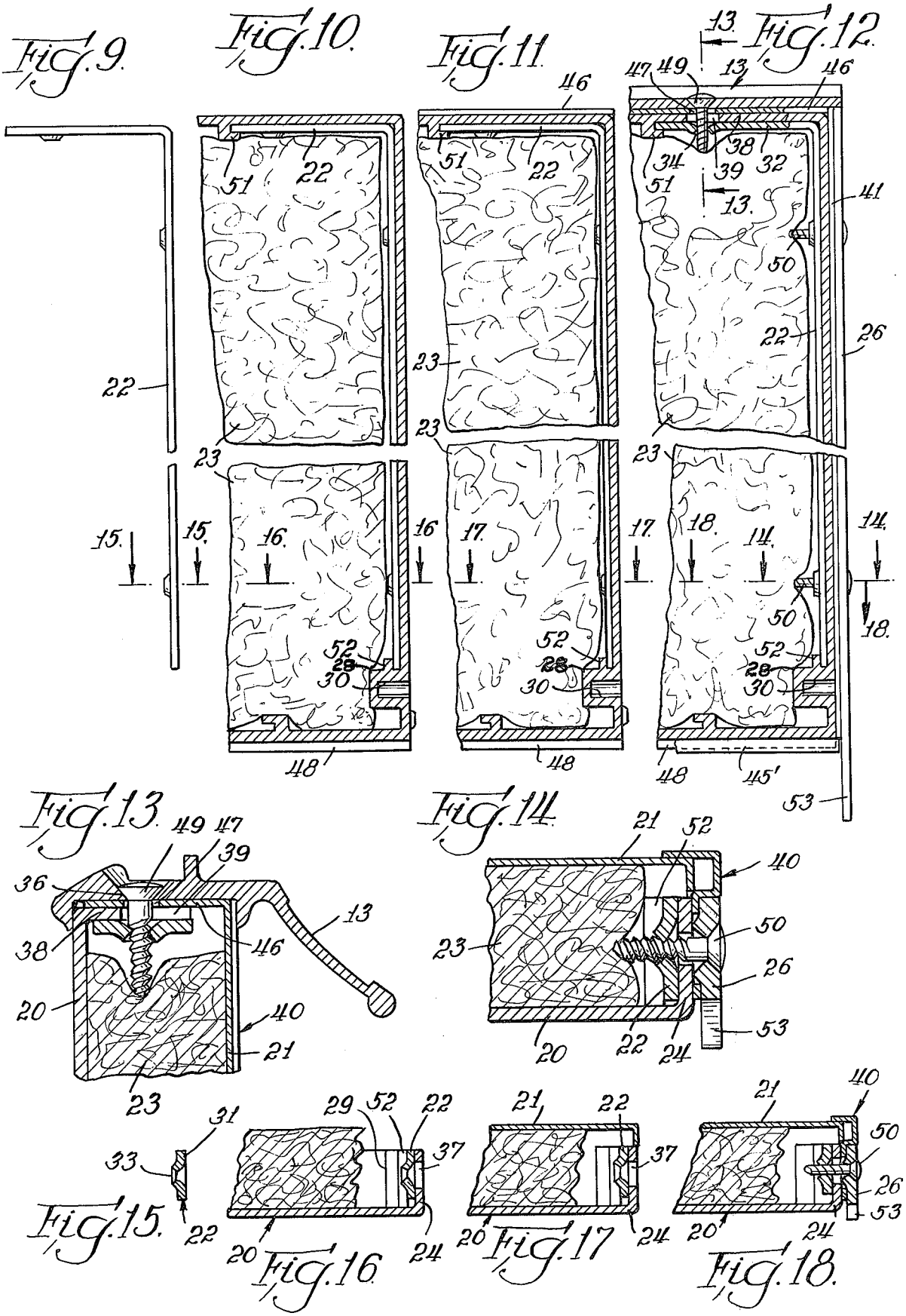
FIG. 9 is a fragmentary elevation of a reinforcing member of the door construction.
FIG. 10 is a fragmentary vertical section illustrating the mounting of the reinforcing member and one portion of the inner door panel.
FIG. 11 is a fragmentary elevation thereof.
FIG. 12 is a fragmentary elevation thereof with the handle and side rail installed.
FIG. 13 is a fragmentary enlarged vertical section taken substantially along the lines 13—13 of FIG. 12.
FIG. 14 is a fragmentary enlarged horizontal section taken substantially along the lines 14—14 of FIG. 12.
FIG. 15 is a horizontal section taken substantially along the lines 15—15 of FIG. 9.
FIG. 16 is a fragmentary horizontal section taken substantially along the lines 16—16 of FIG. 10.
FIG. 17 is a fragmentary horizontal section taken substantially along the lines 17—17 of FIG. 11.
FIG. 18 is a fragmentary horizontal section taken substantially along the lines 18—18 of FIG. 12.

Inner door panel 20 can be a relatively weak panel member, illustratively being formed of molded plastic. As shown in FIGS. 9–12, the reinforcing members 22 provide an improved, simplified means for mounting the handle 13 to the mounting rails 26, 27 in a U-shaped configuration with the side flange portions 24, 25 of the inner door 20 member being intermediately disposed. Thus, as shown in FIG. 10, the reinforcing members 22 may be preliminarily installed in the inner door member by means of tabs 51 and 52 formed integrally therein. As shown in FIG. 12, the mounting side rail 26 is secured to the reinforcing member 22 by the screws 50 extending through the openings 35 of the mounting rail, the openings 42 of the trim strip 40, the openings 37 of the inner door flange 24 and into the openings 33 of the reinforcing member. Screws 50 may be of the self-tapping type so as to form suitable threads in the openings 33 and the reinforcing member in the assembly of the rails to the door. Similarly, as shown in FIG. 12, handle 13 may be secured to the top portion 32 of the reinforcing member by the screw 49 extending downwardly through openings 36 in the handle, openings 47 of the decorator panel top flange 46, slots 39 of the inner door top flange 38 and into the openings 34 of the reinforcing members. Screws 49 may be of the self-tapping type to affect a self threading thereof to the reinforcing members as shown in FIG. 12.

Rear portion 41 of the trim strip 40 is received between the mounting rail and the side flange of the inner door panel. The decorative front panel 21 is retained by the side trim portions 43 with the upper flange portion 46 thereof being retained under the handle 13 and above the inner door portion 38.

The lower flange 45 of the door panel 21 has a portion 45' that locks under the flange 48 of the inner door 20 to complete the secured mounting of the decorative panel in the door construction.

Figure 7:
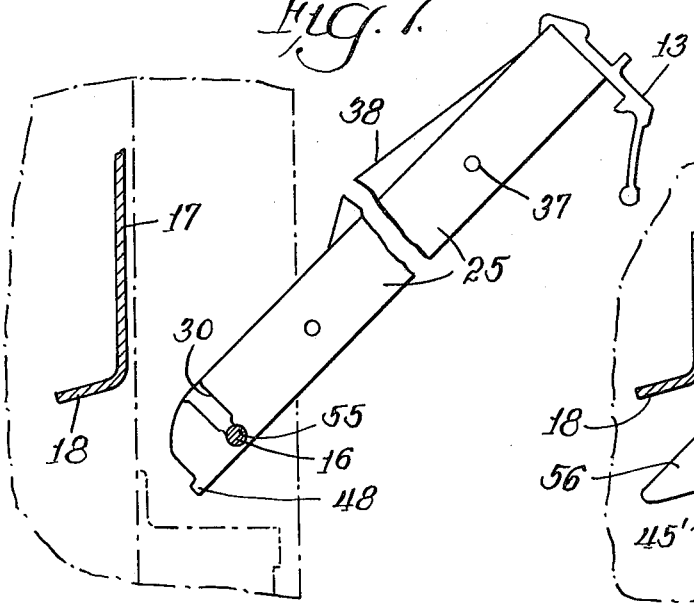
FIG. 7 is a fragmentary vertical section illustrating a step in the mounting of the door to the cabinet prior to the installation of the side rail thereon.
Figure 8:
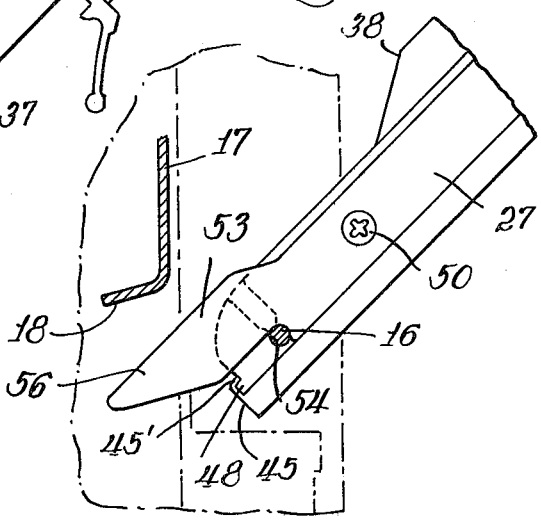
FIG. 8 is a fragmentary vertical section illustrating the arrangement of the door as shown in FIG. 7 with the side rail installed.

Referring now to FIGS. 7 and 8, the mounting of the door construction of the present invention to the cabinet may be affected by installing the door without the side rails mounted thereto with the pivot pins 15 and 16 received in the slots 30 of the block portions 28 and 29 of the inner door. The side rails may then be installed as discussed above by means of the screws 50 which, as shown in FIG. 8, effectively locks the pins behind a lower portion 53 of the side rails. The surface 54 of the side rail portion 53 engaging the pivot pin is arranged so as to define a bearing support for the door at all times, both in the closed position shown in full lines in FIG. 4 and the open position shown in broken lines in FIG. 4. Additionally as shown in FIG. 8, the curvature of the surface 54 provides a support by the rails of the door and all intermediate positions.

As shown in FIG. 7, the slot 30 may have an undercut portion 55 which releasably retains the door on the pivot pin during the installation prior to the mounting of the rails to the sides of the door as discussed above.

The lower portion 53 of the rails includes a stop engaging portion 56 which as shown in FIG. 4 engages the stop 18 on the pivot pin plate 17 to limit the downward swinging of the door to the fully open position shown in broken lines in FIG. 4. In this position, the entire weight or load of the door is supported by the pivot pins and stops through the rail portion 53. As shown in FIG. 4, suitable slots 57 may be provided in the cabinet to permit the swinging of the rail portion 53, 56 into engagement with the stop 18 in an open position of the door.

A facilitated installation of the door construction in the cabinet may be affected by firstly installing one of the side rails and moving the door laterally so as to cause the corresponding pivot pin to enter the pivot opening now defined by the side rail and the rear end of the slot 30 as illustrated in FIG. 8. The opposite side of the door is then brought into alignment with the opposite pivot pin by movement of the opposite slot over the pivot pin to the position of FIG. 7. The opposite side rail may then be installed in overlying relationship to the opposite side of the door construction so as to complete the mounting of the door on the cabinet with the opposite pivot pin being retained in the inner portion 55 of the slot by the now installed second rail end portion 53.

Similarly, the door may be removed by a reverse operation wherein a single rail is removed to permit one side of the door to be swung free of its pivot pin and the door then moved laterally from the opposite pivot pin without requiring removal of the opposite rail.

The door construction of the present invention provides an extremely simple and economical construction, eliminating the need for forming the inner and outer door panels suitably to retain fastening means as these panels are retained in the door construction by a clamped association with the inner reinforcing members and the outer rails. Further, by elimination of the extensive decorative frame of the prior art door constructions, further economies and simplifications are obtained.

The foregoing disclosure of specific embodiments of the invention is elective of the broad inventive concepts thereof.

Having described the invention, the embodiments of the invention in which an exclusive property or privilege is claimed are defined as follows:

1. A door construction comprising:
a door panel having turned edge portions;
an L-shaped inner reinforcing member having one leg juxtaposed to an inner surface of one of said edge portions and having a second leg juxtaposed to an inner surface of an adjacent edge portion;
an outer door mounting rail juxtaposed to an outer surface of said one of said edge portions;
a handle for manipulating the door juxtaposed to said adjacent edge portion; and
securing means securing the mounting rail and handle to said reinforcing member with said one edge portion retained between said mounting rail and said reinforcing member and said adjacent edge portion retained between said handle and said reinforcing member whereby said handle is effectively structurally mounted to said rail.

2. The door construction of claim 1 wherein said securing means comprises threaded means.

3. The door construction of claim 1 wherein said securing means comprises threaded means extending through said door panel turned edge portions into engagement with said reinforcing member.

4. The door construction of claim 1 wherein a decorative front panel is provided having an edge portion retained on said door panel by a trim strip having a first portion engaging the edge portion of said decorative front panel and a second portion retained between said mounting rail and said one edge portion of said door panel.

5. The door construction of claim 1 wherein a decorative front panel is provided having an edge portion retained on said door panel by a trim strip having a first portion engaging the edge portion of said decorative front panel and a second portion retained between said mounting rail and said one edge portion of said door panel, said door panel having a lower locking flange and said decorator panel having a lower portion interlocked with said locking flange.

6. The door construction of claim 1 wherein said door panel is provided with a second edge portion opposed to said one of said edge portions, a second reinforcing member, a second outer door mounting rail, and securing means securing the second mounting rail and handle to the second reinforcing member.

7. The door construction of claim 1 wherein said door panel is provided with a second edge portion opposed to said one of said edge portions, a second reinforcing member, a second outer door mounting rail, and securing means securing the second mounting rail and handle to the second reinforcing member whereby said handle is effectively structurally mounted to both said rails.

8. The door construction of claim 1 wherein said mounting rail defines a pivot bearing surface for mounting the door to a mounting pivot.

9. The door construction of claim 1 wherein said one of said door panel turned edge portions is clampedly retained between said mounting rail and reinforcing member.

10. The door construction of claim 1 wherein said door panel defines a pivotal pin slot for removably receiving a pivot pin, said mounting rail overlying said slot to effectively define therewith a pivot pin bearing receptacle.

11. In a housing having a cabinet provided with a portion defining an opening for providing access to the interior of the cabinet, and a door for selectively closing said opening, the improvement comprising: a pair of opposed pivot pins on the cabinet at opposite sides of the opening; means defining a pair of rearwardly opening slots in the door at opposite sides thereof for receiving one each said pivot pins; a U-shaped frame structure having a transverse upper handle portion and opposite depending leg portions; mounting rails removably carried exteriorly on opposite sides of the door on said leg portions, each of said rails defining a recess, the recesses defining support surfaces engaging said pivot pins for supporting the door for movement between a closed position across said opening and an open position wherein said door extends forwardly from said opening.

12. The housing structure of claim 11 wherein said slots are provided with undercut portions for releaseably retaining said door on said pivot pins in the absence of said mounting rails for facilitated installation and removal of the door relative to said cabinet.

13. The housing structure of claim 11 wherein said mounting rail and slot means cooperatively define pivot pin bearing receptacles, said pivot pins being prevented from movement rearwardly from said slots by said mounting rails.

14. The housing structure of claim 11 wherein said slots are provided with undercut portions for releaseably retaining said door on said pivot pins in the absence of said mounting rails for facilitated installation and removal of the door relative to said cabinet, said mounting rail support surfaces and undercut portions of said slots cooperatively defining pivot pin bearing receptacles, said pivot pins being prevented from movement rearwardly from said undercut portions of said slots by said mounting rails.

15. The housing structure of claim 11 wherein said door includes a door panel having turned edge portions, and a reinforcing member, said turned edge portions being clamped between said mounting rail and said reinforcing member.

16. The housing structure of claim 11 further including a stop engaging means on at least one of said mounting rails for engaging said stop means to limit the pivotal opening movement of the door on said pins to a preselected maximum.

17. The housing structure of claim 16 wherein said stop engaging means comprises an integral extension of said mounting rail.

18. The housing structure of claim 16 wherein said stop engaging means projects rearwardly from the door when said door is in the open position.

19. The housing structure of claim 16 wherein screw means are provided for removably securing to the door at least one of said mounting rails including said stop engaging means.

* * * * *